US011078606B2

(12) United States Patent
Corbellini

(10) Patent No.: US 11,078,606 B2
(45) Date of Patent: Aug. 3, 2021

(54) METHOD AND DEVICE FOR PRODUCING CRIMPED MULTIFILAMENT SYNTHETIC YARN

(71) Applicant: IROPA AG, Baar (CH)

(72) Inventor: Ermete Corbellini, Cosio Valtellino (IT)

(73) Assignee: IROPA AG

( * ) Notice: Subject to any disclaimer, the term of this patent is extended or adjusted under 35 U.S.C. 154(b) by 461 days.

(21) Appl. No.: 15/569,084

(22) PCT Filed: Apr. 22, 2016

(86) PCT No.: PCT/IB2016/052303
§ 371 (c)(1),
(2) Date: Oct. 24, 2017

(87) PCT Pub. No.: WO2016/170509
PCT Pub. Date: Oct. 27, 2016

(65) Prior Publication Data

US 2018/0119314 A1 May 3, 2018

(30) Foreign Application Priority Data

Apr. 24, 2015 (BE) ..... 2015/5272

(51) Int. Cl.
*D02G 1/12* (2006.01)
*D02G 1/16* (2006.01)

(52) U.S. Cl.
CPC ..... *D02G 1/122* (2013.01); *D02G 1/125* (2013.01); *D02G 1/167* (2013.01)

(58) Field of Classification Search
CPC ..... D02G 1/122; D02G 1/125; D02G 1/167; D02G 1/12; D02G 1/161; D02G 1/16;
(Continued)

(56) References Cited

U.S. PATENT DOCUMENTS 3,859,695 A 1/1975 Erickson
3,961,402 A 6/1976 Ferrier
(Continued)

FOREIGN PATENT DOCUMENTS

DE WO2006076933 A1 7/2006
GB 1378768 A 12/1974
(Continued)

OTHER PUBLICATIONS

International Search Report dated Jul. 12, 2016.

*Primary Examiner* — Amy Vanatta
(74) *Attorney, Agent, or Firm* — Fresh IP PLC; Clifford D. Hyra; Aubrey Y. Chen

(57) ABSTRACT

A method for producing at least one crimped multifilament synthetic yarn through the use of a texturing process, wherein a stream of heated gaseous medium is brought into a texturing channel (1), (2), (3), wherein synthetic filaments (4), (5), (6) are displaced and deformed by the heated gaseous medium in the texturing channel (1), (2), (3), wherein both the temperature and the flow rate of the gaseous medium are measured, and wherein the heat flow is regulated. To this end, the device comprises a regulating device (50) and, for each texturing channel (1), (2), (3), at least one temperature sensor (60), (61), (62) and a flow sensor (57), (58), (59).

18 Claims, 2 Drawing Sheets

(58) Field of Classification Search
CPC ..... D02G 1/205; D02J 1/08; D02J 13/001; D06B 5/06; D06B 1/00; D06B 1/02
USPC ..... 28/249, 267
See application file for complete search history.

(56) References Cited

U.S. PATENT DOCUMENTS 4,007,518 A 2/1977 Larson
4,118,843 A 10/1978 Schippers
4,404,718 A * 9/1983 Tajiri ..... D02G 1/167 28/220
4,608,736 A * 9/1986 Tajiri ..... D02G 1/167 28/220
4,796,340 A 1/1989 Gerhards
5,088,168 A 2/1992 Berger
5,187,845 A 2/1993 Duffy
5,351,374 A * 10/1994 Nabulon ..... D02G 1/122 28/248
5,727,293 A * 3/1998 Weder ..... D02G 1/122 2/248
5,737,815 A * 4/1998 Le ..... D02G 1/167 28/220
6,305,059 B1 10/2001 Mayer
6,378,180 B2 4/2002 Maranca
2014/0053381 A1* 2/2014 Boetsch ..... D02G 1/125 28/249
2014/0196264 A1* 7/2014 Boetsch ..... D02G 1/125 28/248
2014/0317895 A1* 10/2014 Stundl ..... D02G 1/122 28/250

FOREIGN PATENT DOCUMENTS

JP H05287630 A 11/1993
JP H05287631 A 11/1993

* cited by examiner

METHOD AND DEVICE FOR PRODUCING CRIMPED MULTIFILAMENT SYNTHETIC YARN

This application is a National Phase entry of International Application No. PCT/IB2016/052303 under § 371 and claims the benefit of Belgian patent application No. BE2015/5272, filed Apr. 24, 2015, which is hereby incorporated by reference in its entirety.

FIELD OF THE DISCLOSURE

This disclosure relates to a method for producing at least one crimped multifilament synthetic yarn through the use of a texturing process, wherein a stream of heated gaseous medium is brought into a texturing channel, wherein a number of synthetic filaments are displaced and deformed by the heated gaseous medium in the texturing channel, and wherein the deformed filaments are fixed, so that a crimped synthetic yarn is obtained.

This disclosure also relates to a device for producing at least one crimped multifilament synthetic yarn through the use of a texturing process, comprising at least one texturing channel and means to feed a stream of heated gaseous medium to each texturing channel, wherein each texturing channel comprises an entrance, along which synthetic filaments can be brought into the channel, and at least one opening, along which the heated gaseous medium can be brought into the texturing channel, means to deform the filaments, and an exit, along which the deformed filaments can leave the texturing channel, wherein the device also comprises means to fix the filaments of each texturing channel in the deformed state.

BACKGROUND

In the production of synthetic yarns, separate filaments are formed from a thermoplastic material, such as, for example, polypropylene, polyester or polyamide. This is effected according to an extrusion process. A number of these filaments are joined together to form a multifilament yarn. It is known to alter and improve the characteristics of a multifilament yarn by a texturing process, for example in order to make this yarn better suitable for specific applications. This is done, for example, by bringing a multifilament yarn into a texturing channel and having it transported therein by a stream of hot air, so that the filaments are deformed. The yarn is subsequently fixed, so that a crimped synthetic yarn is obtained. The yarn hereby becomes more voluminous and acquires a better covering capability, which makes these yarns particularly suitable for use in the weaving and tufting of carpets and the like.

Known texturing devices, such as the device described in U.S. Pat. No. 6,308,388 B1, comprise a texturing unit in which two texturing channels are provided side by side in parallel. Into each texturing channel, a respective multifilament yarn is introduced via an entrance opening. In the vicinity of this entrance opening are provided a number of inlet openings, along which hot air is blown at high velocity into the texturing channel. The multifilament yarn is transported by the hot air into the texturing channels. This air has a temperature which is sufficiently high to bring the synthetic filaments to a temperature at which the synthetic material is soft and easily deforms. Furthermore, each texturing channel also comprises means to deform the yarn, which means take the form, for example, of a 'stuffer box', a more widely constructed zone of the channel, provided with outlet openings along which air can leave the texturing channel. In this zone, the velocity of the air and of the yarn strongly decreases, whereby the yarn is compressed into a yarn plug and the filaments of the yarn deform. The yarn is further displaced as a yarn plug in the texturing channel, in the direction of the exit opening of the texturing channel.

The two yarn plugs, after having left the texturing channels, are laid on the shell surface of a slowly rotating cooling drum in order to cool. The deformations of the filaments are hereby fixed. The thus textured yarn is subsequently led away from the surface of the cooling drum and possibly subjected to additional operations, and is finally wound as a crimped textile yarn onto bobbins.

It is of great importance, that in the production of textile yarns which have been crimped in this way, the same yarn quality is always obtained. This means, on the one hand, that one and the same textile yarn, viewed over the whole of its yarn length, must not exhibit any quality differences, but also that yarns deriving from different texturing processes must have virtually the same yarn quality.

It is known that the characteristics of a textile yarn which has been crimped in this way are defined by the temperature to which it is subjected in the texturing channel.

In NL 175 325 is described a method for producing a crimped textile yarn through the use of a texturing process having the above-specified characteristics. In order to obtain a uniform yarn quality, the temperature in each texturing process is regulated. Based on the finding that the location of the take-off end of the yarn plug on the cooling surface is an indication of the yarn quality, this location is detected, and the temperature is regulated in order to obtain a predetermined target location.

This method is fairly complex and delivers a crimped textile yarn having a quality which exhibits too much variation. Also in yarns which are produced in different texturing processes, the mutual quality differences are disturbing, which raises the question of limiting these still further.

SUMMARY

An object of the present invention is to remedy the above-specified drawbacks by providing a method and a device for producing crimped multifilament synthetic yarns having a more uniform quality.

This object may be achieved, on the one hand, by providing a method having the characteristics from the first paragraph of this description, wherein both the temperature and the flow rate of the gaseous medium are measured, and wherein the heat supply per unit of time that is realized by the introduction of the gaseous medium is regulated by the adjustment or regulation of at least one of the parameters which influence this heat supply.

Between the quantity of heat which is brought per unit of time into the texturing channel by means of the gaseous medium (the heat supply per unit of time or the heat flow), and the final yarn quality, there is a stronger correlation than between the temperature of the gaseous medium and the yarn quality.

Besides the temperature of the gaseous medium, also the flow rate of the introduced stream of the gaseous medium, inter alia, is a parameter which influences the yarn quality. For one and the same temperature of the gaseous medium, a relatively high flow rate will deliver a different yarn quality than will a relatively low flow rate.

The heat supply per unit of time (hereinafter also referred to, in short, as 'the heat supply') is a parameter which takes account of both temperature and flow rate of the introduced stream of gaseous medium, two parameters which significantly influence the yarn quality. As a result, a regulation which allows much less variation of the yarn quality is obtained. By temperature is here preferably meant the absolute temperature of the gaseous medium as this is introduced into the texturing channel. It can thus be assumed, in simplified terms, that the temperature-dependent component of the heat supply to the yarn is primarily defined by the temperature of the gaseous medium as this is introduced into the texture channel. More accurately, the difference between the temperature of the introduced stream of the gaseous medium and the temperature of the gaseous medium as this leaves the texturing channel can be used as indication of the temperature-dependent component of the heat supply.

In order to define the heat supply to the yarn still more accurately, besides the temperature and the flow rate of the introduced stream of gaseous medium, also the temperature and the flow rate of the stream of gaseous medium which leaves the texturing channel can be measured. The flow rate of this outgoing stream of gaseous medium can be influenced by the changing of the counterpressure at the height of the exit opening(s). Other relevant parameters which can be taken into account are the heat transfer from the gaseous medium to the yarn, the flow rate or the velocity of the yarn and the waste heat of the components, etc. In order to limit the environmental losses to a minimum, a good insulation of the texturing channel and its environment is preferably ensured.

In this regulation, the heat supply can be directly regulated by defining an indicative value for the effective heat supply on the basis of the measurement values for temperature and flow rate, and by adjusting the temperature and/or the flow rate such that a target value of the heat supply is attained or maintained.

The heat supply will preferably be indirectly regulated by regulating the temperature and the flow rate such that, for these two parameters, a respective target value is attained or maintained. The desired heat supply is attained once the flow rate and the temperature of the gaseous medium have attained their respective target values. Where only one of the two parameters is regulated, then the target value for the regulated parameter is a variable value which is adjusted as a function of measurement of the other parameter, so that the target value of the regulated parameter and the measurement value of the other parameter deliver the desired heat supply.

Temperature and flow rate can together be regulated in one and the same control circuit, but can also be regulated in separate control circuits.

The temperature must also at the same time have a value which delivers a good yarn. In fact, the filaments must be heated to a temperature at which they are easily deformable. This temperature is, of course, dependent on the base material used. Around the ideal temperature is defined, for example, a material-dependent target range for the temperature, within which the filaments are sufficiently heated and within which the temperature is regulatable in order to regulate the heat supply, as set out above.

A regulation which is strongly preferred is the regulation of the heat supply by regulating the flow rate of the gaseous medium.

The heat supply is also regulatable in two or more simultaneously executed texturing processes such that the mutual difference between the heat supply in two or more processes is minimized. This objective of the regulation does not necessarily require a target value. For example, a specific limit can be defined for the mutual differences in heat supply, wherein the heat supply in one or more processes is regulated such that this limit is not exceeded and/or wherein a warning signal is generated when this limit is exceeded.

The terms value, measurement value and target value in the above account and in that which follows refer, of course, not only to a numerical expression of the magnitude of the said parameter(s), but also to any other possibility of giving expression thereto, such as, for example, a signal which is representative of the magnitude of one or more parameters or which contains or transmits data relating thereto.

The flow rate of the stream of gaseous medium is preferably measured before the gaseous medium has been heated. The temperature is preferably measured just before the gaseous medium is brought into the texturing channel. As the gaseous medium, air is preferably used.

Also different groups of yarns can be produced simultaneously in two or more different texturing devices having own texturing channels and an associated regulating device. These different regulating devices are then preferably also provided to attain one and the same target value for this heat supply per unit of time and/or to minimize mutual differences between the heat supply in the texturing channels of the different texturing devices. To this end, the different regulating devices can be provided with means to automatically exchange information on the heat supply in their respective texturing channels.

In the regulation of the heat supply per unit of time, the heat supply is preferably changed by changing or regulating the flow rate of the gaseous medium and/or the temperature of the heated gaseous medium.

These parameters largely define the heat supply per unit of time and can be changed with fairly simple means. The heat supply is regulatable by simply changing the flow rate of the stream of gaseous medium, whilst the temperature is not changed. The temperature is then set to a fixed value, but is not changed as a function of the heat supply. The temperature is regulatable, for example, in a separate control circuit, to a fixed target value. The flow rate regulation can be effected by regulating the feed pressure of the gaseous medium, or by means of a regulating valve or any other flow-rate-defining device.

The heat supply is also regulatable by simply changing the temperature, whilst the flow rate is not changed. The gaseous medium is brought to the desired temperature, for example, by means of a heat exchanger.

The heat supply is also regulatable by regulating both the temperature and the flow rate of the stream of gaseous medium.

A method which is strongly preferred provides a regulation of the heat supply per unit of time by regulating the flow rate of the stream of gaseous medium in order to attain a specific target value when a variance between the measured value and the target value is established, and/or by regulating the temperature of the stream of heated gaseous medium in order to attain a specific target value when a variance between the measured value and the target value is established.

In this context, the heat supply per unit of time is indirectly regulated by regulating at least one of the said parameters (temperature and/or flow rate) which influence this heat supply. If both parameters are regulated, they have each, of course, a respective target value. Both target values are then preferably defined such that a desired heat supply per unit of time is obtained if these target values are attained.

If only one of the two said parameters (temperature and flow rate) is regulated, then the target value for the regulated parameter is a value which is adjusted as a function of the measurement of the non-regulated parameter, so that the target value of one parameter (the regulated parameter) and the measured value of the other parameter (the non-regulated parameter) delivers the desired heat supply. Such a method is described in the following paragraph.

A particularly preferred method provides that in each texturing process either only the flow rate of the stream of gaseous medium is regulated in order to attain a specific target value, wherein this target value is defined such that the stream of gaseous medium, at a flow rate with this target value and at the measured temperature, delivers a desired heat supply per unit of time, or only the temperature of the stream of heated gaseous medium is regulated in order to attain a specific target value, wherein this target value is defined such that the stream of gaseous medium, at a temperature with this target value and at the measured flow rate, delivers a desired heat supply per unit of time.

In a method in which the flow rate is regulated in order to attain a specific target value, the flow rate, for example, can be changed in a very simple manner by changing or regulating the pressure on the supplied gaseous medium.

In a production process where the gaseous medium has a common feed whence the medium is fed to a plurality of simultaneously working texturing processes, a common pressure, for example, which is the same for the different texturing processes, is settable. The device can then be provided to automatically derive from this set pressure a target value for the flow rate in one or more of the texturing channels.

In a possible method according to this invention, the synthetic filaments in each texturing channel are compressed, so that a respective yarn plug is formed, and the yarn plugs, after having left the texturing channels, are displaced onto a moving cooling surface.

The motional speed of the moving cooling surface can be set in dependence on the speed at which the yarn leaves the texturing channel. This motional speed is also regulatable as a function of the yarn quality. The cooling surface is, for example, a surface provided with perforations, whilst below the surface a vacuum is created, whereby ambient air is sucked in via the perforations. This air stream ensures, on the one hand, a better cooling of the yarn and also ensures, on the other hand, that the yarn is pressed against the cooling surface and is held in a fixed position. The cooling surface is, for example, the shell surface of a rotating cooling drum.

In a particularly advantageous method, the synthetic filaments in each texturing channel are compressed, so that a respective yarn plug is formed, wherein the compressed yarn is added at one end of the yarn plug, whilst at the other end of the yarn plug, termed the take-off end, it is drawn off, so that the yarn plug unravels and the yarn is removed in the crimped state; the location of the take-off end of each yarn plug is detected, and in each texturing process one or more parameters are regulated on the basis of the detected location in order to prevent the locations of the take-off ends of the yarn plugs being outside a predefined take-off zone.

During the production process, in each texturing channel is formed a yarn plug, which on the rear side continually grows through the addition of yarns into the texturing channel, and from which on the front side, which is outside the texturing channel, crimped yarn is continually drawn off. It is found that the foremost end of the yarn plug (the take-off end), during the production process, is not always at the same place. It is also found that a displacement of the take-off end indicates a change in the yarn quality.

By also regulating at least one production parameter as a function of changes in the location of the take-off end, with the aim of reducing changes in the take-off location of one and the same yarn plug and/or keeping the mutual difference between the take-off locations of different yarn plugs as small as possible, crimped yarns having still less variation in their quality are obtained. Changing take-off locations of one and the same yarn plug, or a mutual difference between the take-off locations of different yarn plugs at one and the same set target value for the heat supply, are an indication of the fact that one and the same set target value for the heat supply does not necessarily yield the same effective value of the heat supply in respect of one and the same texturing channel over a specific time interval, or mutually between the different texturing channels, as a result of the influence of other process parameters which have not been taken into account and/or changing process conditions. By the adjustment and/or regulation of at least one production parameter, the effective value of the heat supply is kept as constant and equal as much as possible.

In another particularly preferred method, at least two crimped multifilament yarns are produced simultaneously through the use of a respective texturing process, wherein in each texturing process a number of synthetic filaments are brought by a respective stream of heated gaseous medium into a respective texturing channel; both the temperature and the flow rate of each stream of gaseous medium are measured, and for each texturing channel the heat supply per unit of time that is realized by the introduction of the heated gaseous medium is regulated in order to minimize the differences between the heat supply in the different texturing channels.

This method allows a plurality of crimped yarns to be produced simultaneously in an automated process, with a virtually identical quality. The regulation as a function of the heat supply per unit of time ensures, in fact, a much more efficient control over the yarn quality. As cited earlier, this regulation requires no target value for this heat supply or for the parameters which define this heat supply. In fact, it is sufficient to keep the mutual differences between the heat supply per unit of time in two or more texturing processes as small as possible.

Preferably, the heat supply per unit of time in the different texturing channels is regulated in order to attain or maintain a common target value.

More preferably, the heat supply per unit of time in each texturing channel is regulated by regulating the flow rate of the stream of gaseous medium in order to attain a specific target value and by regulating the temperature of the stream of heated gaseous medium in order to attain a specific target value, and for the different texturing channels the same target values are used.

A regulation of the heat supply in each channel by regulating both the flow rate and the temperature of the stream of gaseous medium is realizable with very simple means and is, moreover, particularly efficient.

The heat supply per unit of time is regulatable in each texturing channel by simply regulating the flow rate. The target value for the flow rate of the stream of gaseous medium can be the same for the different texturing channels. This target value can likewise also be different, for example in order to take account of dirtying of a channel.

For each texturing channel, for example, the following parameters are here measurable: the pressure of the stream of gaseous medium, the flow rate of the stream of gaseous medium, and the temperature of the stream of heated gaseous medium, and at least the pressure and/or the temperature are regulatable in order to obtain a desired heat supply per unit of time in each texturing channel.

In a particularly efficient method, the synthetic filaments in each texturing channel are compressed, so that a respective yarn plug is formed, wherein the compressed yarn is added at one end of the yarn plug, whilst at the other end of the yarn plug, termed the take-off end, it is drawn off, so that the yarn plug unravels and the yarn is removed in the crimped state; the locations of the take-off ends of the different yarn plugs are detected; in each texturing process, one or more parameters are regulated on the basis of the detected location in order to prevent the distance between the farthest apart locations exceeding a predefined maximum, or to prevent the locations of the take-off ends of the yarn plugs being outside a predefined take-off zone.

It is also found that a different location of the take-off end of two simultaneously produced yarn plugs indicates a mutually different yarn quality.

By also regulating one or more production parameters in order to keep the mutual difference between the take-off locations of different yarn plugs as small as possible, two or more crimped yarns having still smaller mutual quality differences can be produced. But it is also possible, either together with or without the first option, to regulate such that the take-off ends remain within the boundaries of a predefined take-off zone.

When two groups of yarns are produced simultaneously, whilst for each group a different regulating unit is provided to regulate one or more production parameters, it is possible, in addition to or as an alternative to the above options for regulating the location of the take-off end, to automatically define for each group of yarns, on a continuous or repetitive basis, a location which is representative of the detected locations of the take-off ends of the different yarn plugs of this group (for example the average of the different locations of the yarn plugs of the group), and to provide the regulating units to regulate the parameters such that the differences between the representative locations associated with the different groups of yarns are minimized.

Also in one single texturing process, one or more parameters are regulatable on the basis of the detected take-off location of the yarn plug in order to prevent the take-off end of the yarn group being outside a predefined take-off zone.

In this method in each texturing process for example, at least one of the following parameters is regulatable on the basis of the detected location of the take-off end of the yarn plug formed in that texturing process: the temperature, the flow rate and the pressure of the gaseous medium.

Also in a single texturing process, these parameters are regulatable on the basis of a detected take-off location.

The detection of the locations of the take-off ends is effected, for example, by a capacitive detection or by, during each texturing process, making image recordings on which the take-off ends of the different yarn groups are visible, wherein each detection of the locations of the take-off ends is effected by automatic analysis and/or processing of one or more image recordings. The image recordings are preferably effected by means of a camera.

A capacitive detection means, for example, that the density of the yarn plug is measured. Instead of a camera, or as supplementary detection means, other optical detection means can also be used to detect the take-off locations of the yarn plugs.

Also in a single texturing process, the take-off location of the yarn plug is detectable with one or more of these detection means.

The efficiency of the regulation can be further increased by a method in which the locations of the take-off ends of the different yarn plugs are detected at at least two successive points in time, wherein, on the basis of the thus established changes in these locations, for each take-off end is defined what location is expected at a later point in time, and wherein regulating means are provided to anticipate an expected location outside the predefined take-off zone by, in the particular texturing process, regulating a parameter in order to keep the take-off end within this take-off zone.

In this way, a still faster reaction can be made and a future unacceptable quality variance is preventable. The said parameter can once again be one or more of the said production parameters (temperature, pressure or flow rate of the gaseous medium), or another parameter which influences the yarn quality.

The earlier indicated objective is also achieved by providing a device having the characteristics from the third paragraph of this description, wherein the device also comprises for each texturing channel a temperature sensor, to measure the temperature of the heated gaseous medium, and a flow sensor, to measure the flow rate of the supplied gaseous medium, and wherein the device also comprises a regulating device, which is provided to regulate the heat supply per unit of time that is realized by the introduction of the stream of gaseous medium into each texturing channel.

For the advantageous effects of the regulation of the heat supply per unit of time, we refer to the above. The device comprises a regulating device to realize this regulation automatically, so that crimped multifilament synthetic yarns can be produced at a high production speed and with a very uniform quality.

The flow sensor and the temperature sensor are preferably arranged one after the other at the height of the entrance along which the gaseous medium is brought into the texturing channel. They measure the characteristics of the medium which draws the yarn into the texturing channel. The flow rate of the stream of gaseous medium is preferably measured before the gaseous medium has been heated. The temperature is preferably measured just before the gaseous medium is brought into the texturing channel. As the gaseous medium, air is preferably used.

In a preferred embodiment, the device comprises for each texturing channel a regulatable heating device to heat the gaseous medium, wherein the said regulating device is provided to change a setting of the heating device, in case of a variance between a specific target temperature and the measured temperature, in order to bring the temperature of the heated gaseous medium to the target temperature, and/or a flow-defining device, with which the flow rate of the supplied stream of gaseous medium is regulatable, wherein the said regulating device is provided to change a setting of the flow-defining device, in case of a variance between a specific target flow rate and the measured flow rate, in order to bring the flow rate of the stream of gaseous medium to the target flow rate, and the regulating device is provided to regulate the heat supply per unit of time by regulating the temperature and/or the flow rate of the gaseous medium.

Through the regulation of at least one of the two parameters which strongly influence the heat supply, a very efficient regulation of the heat supply per unit of time is indirectly achieved, and such a regulation, moreover, is realizable with relatively simple means.

In a strongly preferred embodiment, the said flow-defining device is a pressure regulator in interaction with the said regulating device, wherein the regulating device is provided to change the pressure in the stream of gaseous medium in order to bring the flow rate to the target flow rate.

The regulating device can also be provided to regulate the pressure in order to attain or maintain a predefined target value.

In a production process in which the gaseous medium has a common feed, whence the medium is fed to a plurality of simultaneously working texturing processes, the device can be provided with means for setting or regulating a common pressure which is the same for the different texturing processes. The device or the regulating device can then be provided to automatically derive from this set pressure a target value for the flow rate in one or more of the texturing channels.

In another embodiment, the regulating device is provided to regulate in each texturing process one of the measured parameters, i.e. flow rate and temperature, in order to attain a specific target value; the target value is defined for each texturing process such that the stream of gaseous medium, at this target value of the one parameter (the regulated parameter) and at the measured value of the other parameter (the non-regulated parameter), delivers in the texturing channel a desired heat supply per unit of time.

Preferably, the regulating device is provided to regulate the heat supply per unit of time in each texturing channel by both regulating the flow rate of the stream of gaseous medium in order to attain a specific target value and regulating the temperature of the stream of heated gaseous medium in order to attain a specific target value.

In a particular embodiment of the device according to this invention, each texturing channel is provided to form a respective yarn plug having a take-off end from where the yarn is drawn off in order to remove it in the crimped state, and the device comprises at least one location detecting means to detect the location of the take-off end of each yarn plug.

Since a displacement of the take-off end of the yarn plug indicates a change in the yarn quality, the device can also be provided to regulate at least one production parameter as a function of changes in the location of the take-off end, with the aim of reducing the changes in the take-off location of one and the same yarn plug and/or keeping the mutual difference between the take-off locations of different yarn plugs as small as possible. As a result of all these measures, the quality differences in crimped multifilament synthetic yarns can be reduced still further.

A particularly preferred device according to this invention comprises at least two texturing channels for producing respective crimped multifilament yarns, whilst the regulating device is provided to regulate the heat supply per unit of time, realized by the introduction of the heated gaseous medium into each texturing channel, in order to minimize the mutual differences between the heat supply in the different channels.

This device allows a plurality of crimped yarns to be produced automatically at the same time, with a virtually identical quality. The regulation as a function of the heat supply per unit of time ensures, in fact, a much more efficient control over the yarn quality. As cited earlier, this regulation requires no target value for this heat supply or for the parameters which define this heat supply. In fact, it is sufficient to keep the mutual differences between the heat supply per unit of time in two or more texturing processes as small as possible.

The regulating device can here be provided to regulate the heat supply per unit of time in the different texturing channels in order to attain or maintain a common target value.

In another embodiment of this device, the texturing channels are provided to form respective yarn plugs having take-off ends from where the yarn is drawn off in order to remove it in the crimped state, the device comprises at least one location detecting means to automatically detect the locations of the take-off ends of the different yarn plugs during the texturing process, and the regulating device is provided to in each texturing process, on the basis of the location detected by the location detecting means, regulate one or more parameters in order to prevent the distance between the farthest apart locations exceeding a predefined maximum.

If the take-off ends of different simultaneously produced yarn plugs are at different locations, it is assumed that this indicates a quality difference of the produced yarns. A regulating device, which regulates at least one production parameter as a function of these location differences, can be provided. The objective can here be set to minimize these location differences and/or to ensure that these location differences do not exceed a specific maximum and remain, for example, within a predefined take-off zone.

In a possible embodiment, at least one location detecting means is provided to realize a capacitive detection of the location of the take-off ends.

Preferably, at least one location detecting means comprises an image recording device, which is provided to, during each texturing process, make one or more image recordings on which the take-off ends of the different yarn plugs are visible, and a device for image processing and/or image analysis, which is provided to detect the locations of the take-off ends by an automatic analysis and/or processing of one or more image recordings.

Preferably, the image recording device is provided to make image recordings on a continuous or repetitive basis. Preferably, the image recording device comprises a camera. Of course, any other optical detecting means can also be used.

In a particularly preferred embodiment, each texturing channel is provided to form a respective yarn plug, and the device comprises a movable cooling surface, which is provided to displace the yarn plugs after these have left the texturing channels, whilst the yarns in the crimped state of the yarn plugs present on the cooling surface are drawn off.

The speed at which the cooling surface advances is preferably also regulatable. The movable cooling surface can be, for example, the shell surface of a rotating drum. The cooling surface is preferably provided with perforations along which cooling air is sucked in by a suction device located below the cooling surface. The air stream ensures that the yarns experience a downward force, whereby they are held stably on the cooling surface.

BRIEF DESCRIPTION OF THE DRAWINGS

In order to further illustrate the characteristics of the invention, there hereinafter follows a detailed description of a possible embodiment of a texturing device according to this invention. We emphasize that this is only an example of the many possible embodiments within the framework of the invention, and that this description is in no sense to be regarded as a limitation of the scope of the protection. In this detailed description, reference is made by means of reference numerals to the hereto appended FIG. 1, which is a schematic representation of a texturing device according to this invention, and FIG. 2, which is a more detailed schematic representation of the texturing unit of the texturing device of FIG. 1.

DETAILED DESCRIPTION

Figure 1:
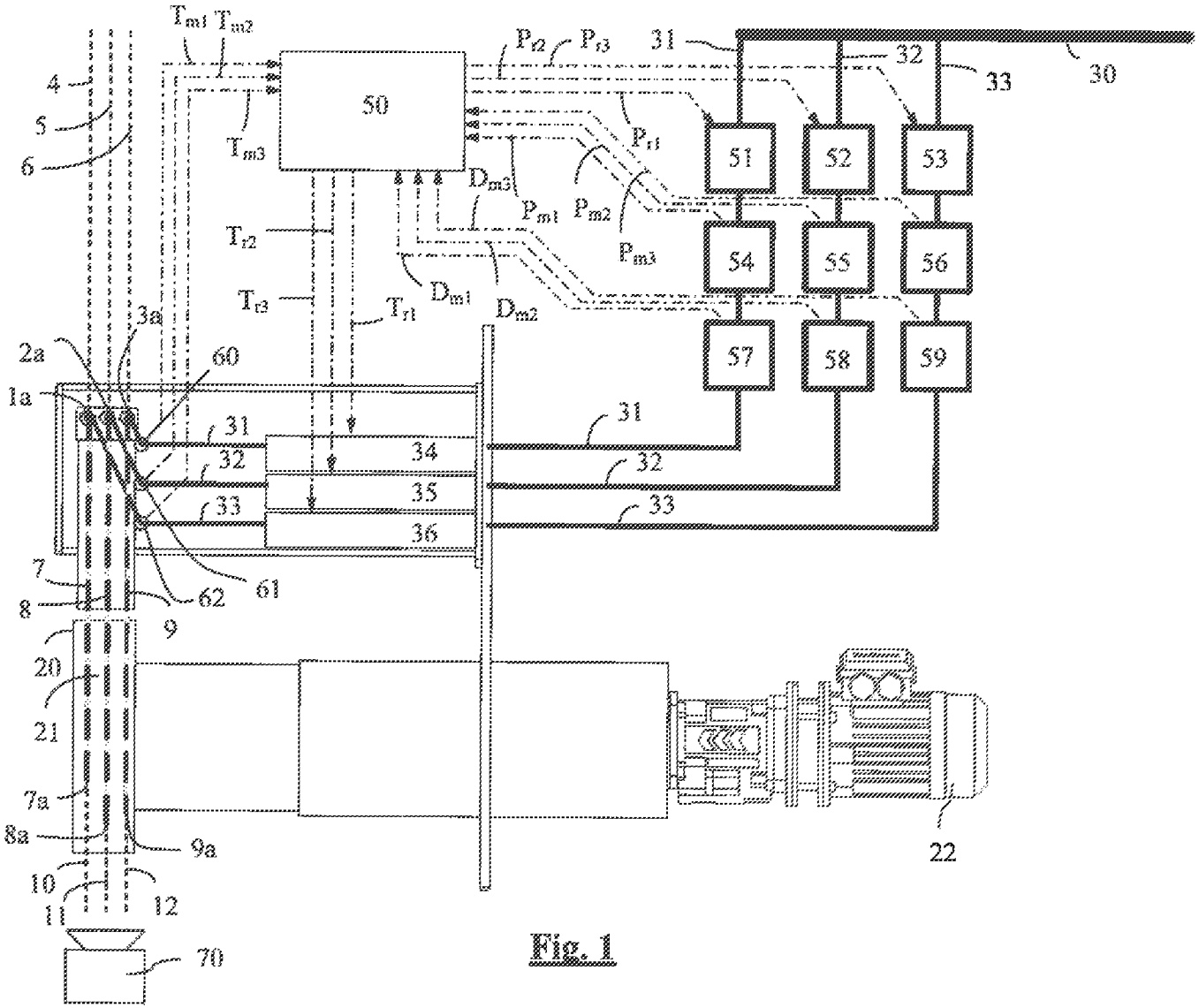
Figure 2:
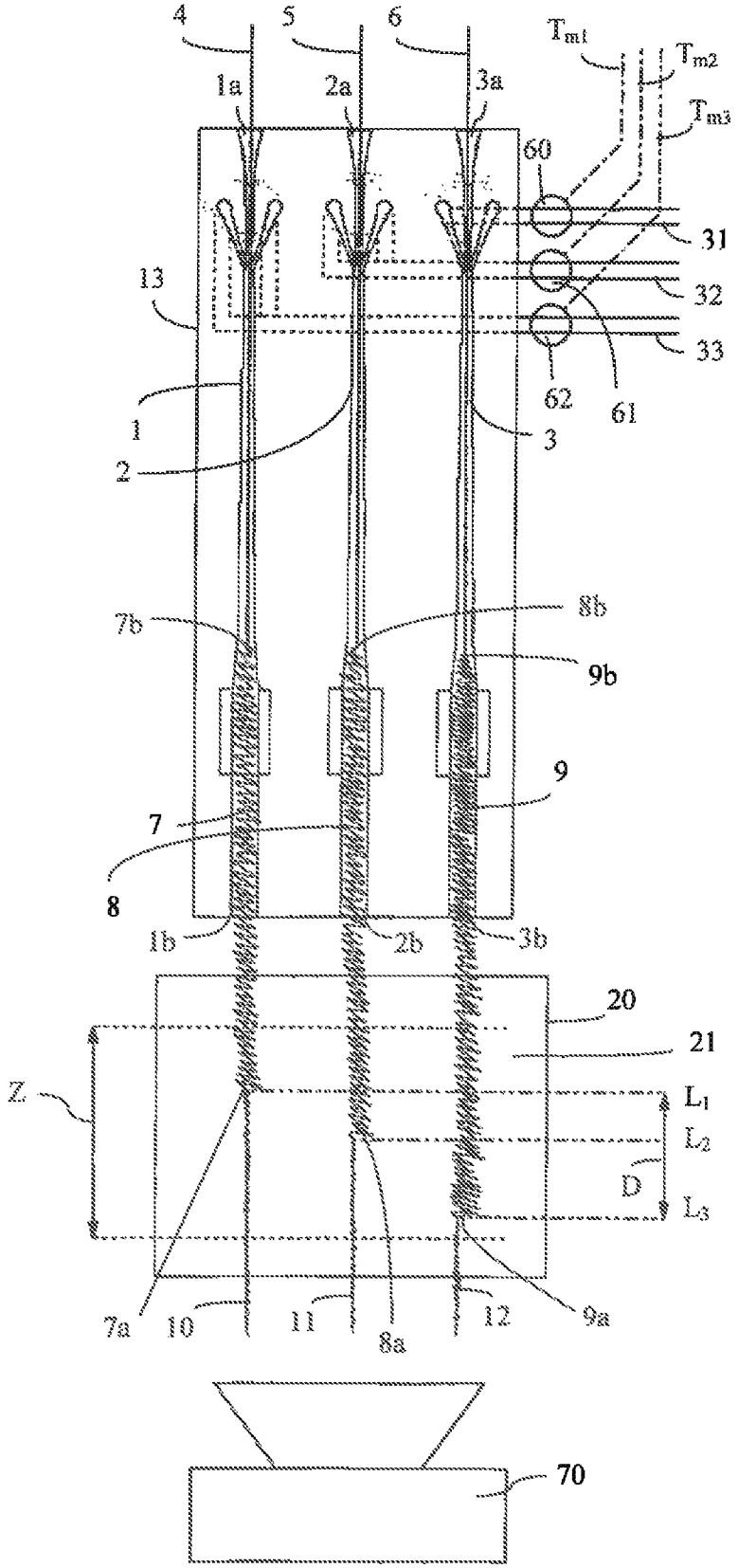

The texturing device represented in FIG. 1 comprises a texturing unit (13) (represented in detail in FIG. 2), in which are provided three texturing channels (1), (2), (3) having a respective yarn entrance (1*a*, 2*a*, 3*a*), for the introduction of a multifilament synthetic yarn (4), (5), (6), and a respective yarn exit (1*b*), (2*b*), (3*b*), along which the textured yarn compressed into a yarn plug (7), (8), (9) can leave the texturing channels (1), (2), (3) again. In addition, the texturing device also comprises a rotatable cooling drum (20), which is drivable by a motor (22) (see also FIG. 1).

From a common feed line (30), compressed air under high pressure (for example a pressure between 5 and 9 bar, preferably between 6 and 8 bar, preferably 7 bar) is brought via three separate feed lines (31), (32), (33) to the respective texturing channels (1), (2), (3) (see also FIG. 1). Each texturing channel comprises an access opening (not visible in the figure), to which is connected a feed line (31), (32), (33) and along which the compressed air can be brought into the texturing channel. Each feed line (31), (32), (33) is interrupted in the vicinity of the texturing channels (1), (2), (3) by a heating element (34), (35), (36), so that the supplied air can be heated to a high temperature (for example a temperature between 120° C. and 220° C., preferably between 130° C. and 200° C., preferably between 150° C. and 180° C.), before this is fed into the texturing channel (1), (2), (3).

In addition, the device also comprises a regulating device (50) having associated sensors and regulating units as set out below.

For each feed line (31), (32), (33) there is provided a pressure sensor (54), (55), (56) and a pressure regulator (51), (52), (53). Each pressure sensor (54), (55), (56) measures the pressure of the compressed air in a respective feed line (31), (32), (33) in the portion located in front of the heating elements (34), (35), (36), and is provided to send to the regulating device (50) a measuring signal ($P_{m1}$), ($P_{m2}$), ($P_{m3}$) representing the magnitude of the pressure in this feed line (31), (32), (33).

Each pressure regulator (51), (52), (53) is provided to change the pressure in the associated feed line (31), (32), (33) in accordance with a regulating signal ($P_{r1}$), ($P_{r2}$), ($P_{r3}$) which is emitted by the regulating device (50).

For each feed line (31), (32), (33) there is also provided a flow meter or flow sensor (57), (58), (59), which is provided to send to the regulating device (50) a measuring signal ($D_{m1}$), ($D_{m2}$), ($D_{m3}$) representing the magnitude of the flow rate in the particular feed line (31), (32), (33). The flow rate is measured in each feed line, in the portion located between the pressure sensor (54), (55), (56) and the heating element (34), (35), (36).

In each texturing channel (1), (2), (3), close to the opening where the compressed air is blown into the texturing channel, there is placed a temperature sensor (60), (61), (62). Each temperature sensor (60), (61), (62) is provided to send to the regulating unit (50) a measuring signal ($T_{m1}$), ($T_{m2}$), ($T_{m3}$) representing the absolute temperature in the particular feed line (31), (32), (33). The setting of each heating element (34), (35), (36) is regulatable and is designed so that the setting thereof is changed such that the temperature of the gaseous medium in the associated feed line (31), (32), (33) is changed in accordance with a regulating signal ($T_{r1}$), ($T_{r2}$), ($T_{r3}$) which is emitted by the regulating device (50). The temperature is thus regulated in a separate control circuit in order to attain or maintain a predefined value, this value being dependent on the base material. In this embodiment, this temperature is not regulated in order to influence the heat supply. The regulation of the heat supply is here realized purely by regulating, via the pressure, the flow rate in each feed line (31), (32), (33) on the basis of the measured temperature and the measured flow rate of the air stream.

For each texturing channel, the measuring signal ($T_{m1}$), ($T_{m2}$), ($T_{m3}$) of the temperature sensor (60), (61), (62) and the measuring signal ($D_{m1}$), ($D_{m2}$), ($D_{m3}$) of the flow sensor (57), (58), (59) indicate what is the heat supply in the particular texturing channel (1), (2), (3).

The regulating device is provided to detect on the basis of these measuring signals for each texturing channel that the heat supply changes over time. This can be a change relative to the original value or relative to a predefined target value. The regulating device is provided to change the flow rate in the associated feed line (31), (32), (33), when such changes are detected, such that the heat supply is restored to the desired level. As already stated, to this end, for the heat supply per unit of time, a specific target value can be set, but for the flow rate too there can be set a specific target value which is defined such that the compressed air stream with the measured temperature and with a flow rate which is equal to the target value realizes the desired heat supply. This target value will then in the course of the production process be automatically adjusted to the measured temperature.

In an additional or an alternative setting, the regulating device (50) can also be provided to detect on the basis of the said measuring signals ($T_{m1}$), ($T_{m2}$), ($T_{m3}$) of the temperature sensor (60), (61), (62) and the said measuring signals ($D_{m1}$), ($D_{m2}$), ($D_{m3}$) of the flow sensor (57), (58), (59) that there are mutual differences between the heat supply in the three texturing channels (1), (2), (3), or that these differences exceed a predefined limit, and to change the flow rate in one or more feed lines, when such differences are detected, such that the heat supply in the three texturing channels (1), (2), (3) is brought back equal or is brought within the predefined limits.

The changing of the flow rate in a specific feed line (31), (32), (33) is effected by changing the pressure in the particular feed line. The pressure is then changed such that the desired flow rate in the feed line is obtained. The pressure in a feed line (31), (32), (33) is thus regulated, by means of a regulating signal ($P_{r1}$), ($P_{r2}$), ($P_{r3}$) emitted to the pressure regulator (51), (52), (53), as a function of the difference between the measured flow rate ($D_{m1}$), ($D_{m2}$), ($D_{m3}$) in this feed line and the flow rate which is necessary to attain the desired heat supply at the temperature which is measured at a specific moment, wherein the regulation, of course, has the aim of bringing this difference to zero.

With this device, crimped multifilament synthetic yarn is produced from thermoplastic materials, such as, for example, polypropylene, polyester, polyamide 6 or polyamide 6.6. As an example, the production of such synthetic yarn from polypropylene is described. For other base materials, this production proceeds in a totally analogous manner.

From polypropylene, according to a known extrusion process, filaments are formed, and by joining together various of these filaments (between 120 and 288 filaments, preferably between 150 and 250) in a known manner, a multifilament yarn is formed. In order to obtain a crimped yarn having a particularly uniform quality, for example in order to make the yarn suitable for the weaving of carpets, these yarns are subjected to a texturing process with the use of the above-described device. The crimped yarn typically has a linear density (titre) which is between 1000 dtex (grams per 10 km length) and 3000 dtex.

Three polypropylene multifilament yarns (4), (5), (6) are brought via the yarn entries (1*a*), (2*a*), (3*a*) into a respective texturing channel (1), (2), (3), whilst compressed air at a high temperature (for example a temperature between 120° C. and 220° C., preferably between 130° C. and 200° C., preferably between 150° C. and 180° C.), is blown at high velocity into these texturing channels. The compressed air is fed via the common line (30) under a pressure of between 5 and 9 bar, preferably between 6 and 8 bar, preferably 7 bar, and is brought via the feed lines (31), (32), (33) and the heating elements (34), (35), (36) to the respective texturing channels (1), (2), (3). Typical values for the flow rate of the compressed air lie between 50 litres/minute and 300 litres/minute.

The pressure in the feed lines (31), (32), (33) is measured by means of the pressure sensors (54), (55), (56), which send a corresponding measuring signal ($P_{m1}$), ($P_{m2}$), ($P_{m3}$) to the regulating device (50).

The flow rate in the feed lines (31), (32), (33) is measured by means of the flow sensors (57), (58), (59), which send a corresponding measuring signal ($D_{m1}$), ($D_{m2}$), ($D_{m3}$) to the regulating device (50).

The regulatable heating elements (34), (35), (36) are regulated in a separate control circuit in order to bring the compressed air to a suitable temperature. The actual temperature of the introduced compressed air is measured in each texturing channel (1), (2), (3) by the temperature sensors (60), (61), (62), which send a respective measuring signal ($T_{m1}$), ($T_{m2}$), ($T_{m3}$) to the regulating device (50). Via a separate control circuit, each heating element (34), (35), (36) is regulated in order to attain or maintain the desired temperature for the compressed air. To this end, the regulating device (50) sends regulating signals ($T_{r1}$), ($T_{r2}$), ($T_{r3}$) to the respective heating elements (34), (35), (36).

The air has a temperature which is sufficiently high to bring the synthetic filaments to a temperature at which the synthetic material is soft and deforms easily.

The filament yarn (4), (5), (6) is transported by the hot air into the texturing channels (1), (2), (3). Each texturing channel is also provided with a 'stuffer box', mainly consisting of a widening of the texturing channel and a number of openings along which the air can leave the texturing channel (this in not indicated in the figure). As a result, the filaments experience a sudden retardation, whereby the yarn (4), (5), (6) is compressed into a yarn plug (7), (8), (9) and the filaments of the yarn deform. This yarn plug (7), (8), (9) is further displaced in the texturing channel (1), (2), (3) and leaves the texturing channel via the exit opening (1*b*), (2*b*), (3*b*).

The three yarn plugs (7), (8), (9), after having left their respective texturing channels (1), (2), (3), are laid side by side on the shell surface (21) of a rotating cooling drum (20) in order to cool and in order to fix the deformations. The cooling drum is rotated by means of a motor (22), so that a specific peripheral speed is attained on the cooling drum, preferably between 40 and 100 m per minute. This speed is settable and regulatable.

The crimped yarn is drawn off from the foremost ends (7*a*), (8*a*), (9*a*) of the advancing yarn plugs (7), (8), (9)—termed the take-off ends—at a greater speed than the said peripheral speed and led away from the surface of the cooling drum (21) in order to be wound onto bobbins (not represented in the figure).

The locations ($L_1$), ($L_2$), ($L_3$) of the take-off ends (7*a*), (8*a*), (9*a*) are detected by means of a camera (70). To this end, the image recordings of this camera (70) are automatically analysed on a continuous basis and processed in an image processing unit (not represented).

On the basis of these image recordings, it is in particular determined to what degree the location ($L_1$), ($L_2$), ($L_3$) of the take-off end (7*a*), (8*a*), (9*a*) of each yarn plug (7), (8), (9) varies from a specific target location, and/or to what degree these locations ($L_1$), ($L_2$), ($L_3$) mutually differ from one another.

More specifically, the distance (D) between the farthest apart locations ($L_1$), ($L_2$), ($L_3$) of the take-off ends (7*a*), (8*a*), (9*a*), for example, is controlled (see FIG. 2), and the regulating device (50) is provided to regulate one or more parameters on the basis of the detected locations ($L_1$), ($L_2$), ($L_3$) in order to prevent this distance (D) exceeding a predefined maximum. In an alternative set-up or by way of addition, the regulating device (50) can also be provided to prevent, by regulating one or more parameters, the take-off ends (7*a*), (8*a*), (9*a*) of the yarn plugs (7), (8), (9) being outside a predefined take-off zone (Z).

The invention claimed is:

1. Method for producing at least one crimped multifilament synthetic yarn through the use of a texturing process, comprising:

bringing a stream of heated gaseous medium into a texturing channel, displacing and deforming a number of synthetic filaments by the heated gaseous medium in the texturing channel, and fixing the deformed filaments, so that a crimped synthetic yarn is obtained, wherein both temperature and flow rate of the gaseous medium are measured, and a heat supply per unit of time that results by introduction of the gaseous medium is regulated to achieve or maintain a predetermined target value for the heat supply by adjustment or regulation of at least one parameter which influences the heat supply.

2. Method for producing at least one crimped multifilament synthetic yarn, according to claim 1, characterized in that, in the regulation of the heat supply per unit of time, the heat supply is changed by changing or regulating the flow rate of the gaseous medium and/or the temperature of the heated gaseous medium.

3. Method for producing at least one crimped multifilament synthetic yarn, according to claim 1, characterized in that the heat supply per unit of time is regulated by regulating the flow rate of the stream of gaseous medium in order to attain a specific target value when a variance between the measured value and the target value is established, and/or by regulating the temperature of the stream of heated gaseous medium in order to attain a specific target value when a variance between the measured value and the target value is established.

4. Method for producing at least one crimped multifilament synthetic yarn, according to claim 3, characterized in that in the texturing process either only the flow rate of the stream of gaseous medium is regulated in order to attain a specific target value, wherein this target value is defined such that the stream of gaseous medium, at a flow rate with this target value and at the measured temperature, delivers a desired heat supply per unit of time, or only the temperature of the stream of heated gaseous medium is regulated in order to attain a specific target value, wherein this target value is defined such that the stream of gaseous medium, at a temperature with this target value and at the measured flow rate, delivers a desired heat supply per unit of time.

5. Method for producing at least one crimped multifilament synthetic yarn, according to claim 1, characterized in that the flow rate is regulated in order to attain a specific target value for the flow rate, and in that the flow rate is changed by changing or regulating pressure on the supplied gaseous medium.

6. Method according to claim 1, characterized in that the synthetic filaments in the texturing channel are compressed, so that a respective yarn plug is formed, and in that the yarn plugs, after having left the texturing channel, are displaced onto a moving cooling surface.

7. Method for producing at least one crimped multifilament synthetic yarn, according to claim 1, characterized in that the synthetic filaments in the texturing channel are compressed, so that a respective yarn plug is formed, wherein the compressed yarn is added at one end of the yarn plug, whilst at the other end of the yarn plug, being the take-off end, the compressed yarn is drawn off, so that the yarn plug unravels and the yarn is removed in the crimped state, in that the location of the take-off end of the yarn plug is detected, and in that in the texturing process one or more parameters are regulated on the basis of the detected location in order to prevent the locations of the take-off ends of the yarn plugs being outside a predefined take-off zone.

8. Method for producing at least one crimped multifilament synthetic yarn, according to claim 1, characterized in that at least two crimped multifilament yarns are produced simultaneously through the use of a respective texturing process, wherein in each texturing process a number of synthetic filaments are brought by a respective stream of heated gaseous medium into a respective texturing channel, in that both the temperature and the flow rate of each stream of gaseous medium are measured, and in that for each texturing channel the heat supply per unit of time that is realized by the introduction of the heated gaseous medium is regulated in order to minimize the differences between the heat supply in the different texturing channels.

9. Method for producing at least one crimped multifilament synthetic yarn, according to claim 8, characterized in that the heat supply per unit of time in the different texturing channels is regulated in order to attain or maintain a common target value.

10. Method for producing at least one crimped multifilament synthetic yarn, according to claim 8, characterized in that the heat supply per unit of time in each texturing channel is regulated by regulating the flow rate of the stream of gaseous medium in order to attain a specific target value and by regulating the temperature of the stream of heated gaseous medium in order to attain a specific target value, and in that for the different texturing channels the same target values are used.

11. Method for producing at least one crimped multifilament synthetic yarn, according to claim 8, characterized in that for each texturing channel the following parameters are measured:

the pressure of the stream of gaseous medium, the flow rate of the stream of gaseous medium, and the temperature of the stream of heated gaseous medium, and in that at least the pressure and/or the temperature are regulated in order to obtain a desired heat supply per unit of time in each texturing channel.

12. Method for producing at least one crimped multifilament synthetic yarn, according to claim 8, characterized in that the synthetic filaments in each texturing channel are compressed, so that a respective yarn plug is formed, wherein the compressed yarn is added at one end of the yarn plug, whilst at the other end of the yarn plug, being the take-off end, the compressed yarn is drawn off, so that the yarn plug unravels and the yarn is removed in the crimped state, in that the locations of the take-off ends of the different yarn plugs are detected, in that in each texturing process one or more parameters are regulated on the basis of the detected location in order to prevent the distance between farthest apart locations from exceeding a predefined maximum, or to prevent the locations of the take-off ends of the yarn plugs being outside a predefined take-off zone.

13. Method for producing at least one crimped multifilament synthetic yarn, according to claim 12, characterized in that in each texturing process at least one of the following parameters is regulated on the basis of the detected location of the take-off end of the yarn plug formed in that texturing process: the temperature, the flow rate and the pressure of the gaseous medium.

14. Method for producing at least one crimped multifilament synthetic yarn, according to claim 12, characterized in that the detection of the locations of the take-off ends is effected by a capacitive detection or by, during each texturing process, making image recordings on which the take-off ends of the different yarn groups are visible, wherein each detection of the locations of the take-off ends is effected by automatic analysis and/or processing of one or more image recordings.

15. Method according to claim 12, characterized in that the locations of the take-off ends of the different yarn plugs are detected at at least two successive points in time, in that, on the basis of established changes in these locations, for each take-off end is defined what location is expected at a later point in time, and in that regulators are provided to anticipate an expected location outside the predefined take-off zone by, in the particular texturing process, regulating a parameter in order to keep the take-off end within this take-off zone.

16. Method for producing at least one crimped multifilament synthetic yarn, according to claim 1, further comprising:

measuring temperature and flow rate of the gaseous medium as the gaseous medium exits the texturing channel.

17. Method for producing at least one crimped multifilament synthetic yarn, according to claim 16, characterized in that the heat supply is defined based on the temperature and the flow rate of the gaseous medium, and the temperature and the flow rate of the gaseous medium as the gaseous medium exits the texturing channel.

18. Method for producing at least one crimped multifilament synthetic yarn through the use of a texturing process, comprising:

bringing a stream of heated gaseous medium into a texturing channel;

measuring both temperature and flow rate of the gaseous medium;

regulating a heat supply per unit of time that depends on both the temperature and the flow rate of the gaseous medium, the regulating comprising determining a target value for the heat supply and, based on the measured temperature and the measured flow rate, adjusting or regulating at least one of the temperature and the flow rate so as to achieve or maintain the target value;

displacing and deforming a number of synthetic filaments by the heated gaseous medium in the texturing channel; and fixing the deformed filaments, so that a crimped synthetic yarn is obtained.

* * * * *